US005456530A

United States Patent [19]

Blaize

[11] Patent Number: 5,456,530

[45] Date of Patent: Oct. 10, 1995

[54] STORAGE CABINET WITH ROTARY TRAYS

[76] Inventor: Jack Blaize, 41, rue des Marais, 45130 Meung Sur Loire, France

[21] Appl. No.: 324,617

[22] Filed: Oct. 18, 1994

[51] Int. Cl.[6] ..... A47B 88/18

[52] U.S. Cl. ..... 312/319.6; 312/305

[58] Field of Search ..... 312/319.6, 97.1, 312/319.7, 266, 249.2, 305

[56] References Cited

U.S. PATENT DOCUMENTS

| | | | |
|---|---|---|---|
| 2,800,382 | 7/1957 | Engstrom | 312/305 |
| 2,803,513 | 8/1957 | Davey | 312/305 |
| 2,905,518 | 9/1959 | Doeskin | 312/319.6 |
| 3,071,426 | 1/1963 | Wassell | 312/305 |
| 3,123,415 | 3/1964 | Carter | 312/97.1 |
| 3,221,890 | 12/1965 | Wassell | 312/305 X |
| 3,698,779 | 10/1972 | Holmes et al. | 312/305 X |
| 3,982,800 | 9/1976 | Gorton et al. | 312/305 |
| 4,181,037 | 1/1980 | Boon et al. | 312/305 X |
| 4,229,060 | 10/1980 | Brownlee et al. | 312/249.2 X |
| 4,239,311 | 12/1980 | Brownlee et al. | 312/249.2 X |
| 4,273,393 | 6/1981 | Foley et al. | 312/97.1 |
| 4,418,970 | 12/1983 | Hyder et al. | 312/305 |
| 4,433,885 | 2/1984 | Baker | 312/305 X |
| 4,440,459 | 4/1984 | Hallgren | 312/305 X |
| 4,486,106 | 12/1984 | Benting | 312/305 X |
| 4,632,474 | 12/1986 | Ingersoll | 312/305 |
| 4,688,686 | 8/1987 | Mitts et al. | 312/305 X |
| 4,738,495 | 4/1988 | Mitts | 312/305 |

*Primary Examiner*—Jose V. Chen
*Assistant Examiner*—Rodney B. White
*Attorney, Agent, or Firm*—Sughrue, Mion, Zinn, Macpeak and Seas

[57] ABSTRACT

A storage cabinet includes a plurality of superposed trays for storing objects of small size, the trays being mounted to rotate about a common vertical axis by a vertical drive shaft controlled by an electric motor. Each tray is adapted to be selectively engaged with the drive shaft independently of the other trays. In one embodiment, the vertical axis is a hollow vertical post and it contains the drive shaft. Each tray includes an inside periphery provided with inside teeth, the hollow post has windows through its wall to face each of the trays, and the inside teeth of each tray are disposed to face one of the windows. The cabinet further includes, for each tray, a clutch device which comprises a moving gear wheel passing through the window and adapted to engage simultaneously with the drive shaft and with the inside teeth of the tray, and a mechanism for axially displacing the gear wheel parallel to the drive shaft between a clutched or engaged position and an unclutched position.

13 Claims, 4 Drawing Sheets

FIG.1
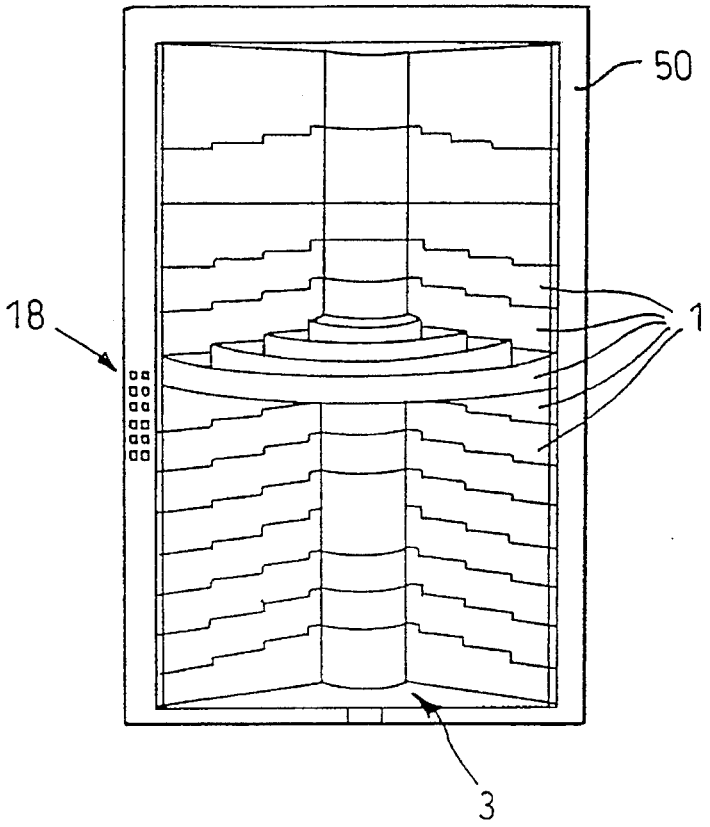
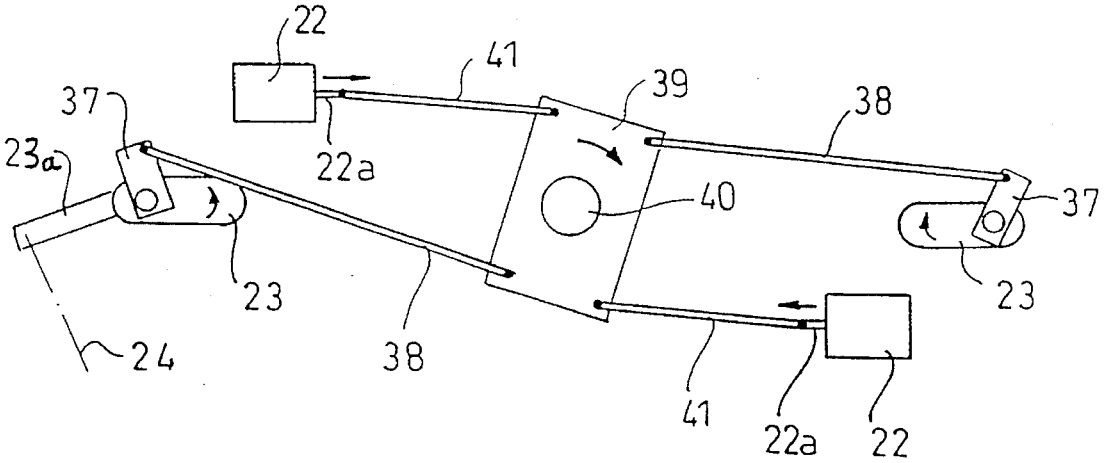
FIG.7

STORAGE CABINET WITH ROTARY TRAYS

The present invention relates to a storage cabinet with rotary trays for storing numerous objects of small size, in particular objects of several different types. For example, the invention is particularly adapted for storing a supply of medicines in a pharmacy.

BACKGROUND OF THE INVENTION

Document EP-A-0 416 973 describes a cabinet with rotary trays as already invented by the present inventor. That document describes a cabinet having superposed trays for storing objects of small size, said trays being mounted to rotate about a common vertical axis, the trays being rotated by a vertical drive shaft controlled by an electric motor, the cabinet also including clutch means adapted to selectively engage the drive shaft with each tray independently of the other trays.

Nevertheless, the cabinet disclosed in document EP-A-0 416 973 suffers from the drawback that the drive shaft engages the outer periphery of the trays which is accessible from outside the cabinet. This outer periphery may engage the drive shaft by friction, in which case it is advantageous to cover it with a friction coating. Unfortunately, such a coating wears rather quickly and it is sensitive to dirt, which can be troublesome since it is accessible from outside the cabinet. When the friction coating is worn or dirty, it must be replaced, or possibly the tray must be replaced, and that is expensive. In a variant, the outer periphery of the tray that engages the drive shaft may be provided with gear teeth, however such gear teeth can also become dirty or receive foreign bodies that impede proper meshing with the drive shaft; they can also injure the user, and they are unattractive in appearance.

OBJECTS AND SUMMARY OF THE INVENTION

An object of the present invention is therefore to provide a cabinet with rotary trays of the type mentioned above, in which the drive shaft engages the trays via portions thereof that are not accessible from outside the cabinet.

According to the invention, this technical problem is solved by a storage cabinet including superposed trays for storing objects of small size, said trays being mounted to rotate a common vertical axis, the trays being rotated by a vertical drive shaft controlled by an electric motor, each tray being adapted to be selectively engaged with the drive shaft independently of the other trays, wherein said vertical axis is embodied as a hollow vertical post, said drive shaft is disposed inside said hollow post, each tray includes an inside periphery provided with a drive surface, the hollow post includes, for each tray, a window through its wall facing the drive surface of the tray, and the cabinet includes, for each tray, clutch means comprising:

a wheel mounted to rotate about a vertical axis and passing through said window, the wheel being adapted to be in engagement simultaneously with the drive shaft and with the drive surface of the tray; and means for selectively either coupling said tray to the drive shaft by means of said wheel, or else to decoupling said tray from the drive shaft.

Since the trays are driven from the inside, the portions thereof engaging the drive shaft are not accessible from outside the cabinet. This inside drive is made possible by the fact that the drive shaft is disposed inside the hollow vertical post on which the trays are mounted.

In one embodiment, for each tray, said drive surface is constituted by inside teeth, and said wheel is a gear wheel. For each tray, said wheel may be permanently engaged with the drive surface of said tray, and said means for selectively either coupling said tray to the drive shaft by the means of said wheel or else decoupling said tray from the drive shaft are means for selectively coupling said wheel to the drive shaft or for decoupling it from the drive shaft. Advantageously, for each tray, said clutch means further includes mechanical coupling means integral with the drive shaft, said wheel is axially displaceable parallel to the drive shaft between a clutched position where it is in engagement both with said tray and with said mechanical coupling means integral with the drive shaft, and a declutched position in which it is not in engagement both with said tray and with said mechanical coupling means integral with the drive shaft, and said means for selectively either coupling said tray to the drive shaft by the means of said wheel, or else decoupling said tray from the drive shaft comprise: means for displacing the wheel towards its clutched position independently of the position of the wheels corresponding to the other trays; and means for displacing the wheel towards its declutched position.

Advantageously, said hollow vertical post is made up of cylindrical elements that are superposed and secured to one another. Thus, assembly is greatly facilitated by the fact that the central post is made up of a stack of cylindrical elements that enable the clutch means for each tray to be assembled while the stack of cylindrical elements is being built up. Similarly, the stacked cylindrical elements facilitate disassembly.

In order to facilitate assembly of the cylindrical elements and reduce the cost of manufacturing the cabinet, and possibly also to facilitate maintenance, the cylindrical elements on which the trays are mounted to rotate may all be identical.

To facilitate assembly of the cabinet, it is advantageous for the drive shaft to be made up of lengths that are disposed end-to-end and that are constrained to rotate with one another, each length including mechanical coupling means adapted to couple the length to one of the wheels, with each length being mounted to rotate by being engaged in two bearings forming parts of two respective adjacent ones of the cylindrical elements. Thus, the bearings may be formed directly in the cylindrical elements of the central post, or they may be fixed in advance to said cylindrical elements, with assembly of the drive shaft consisting merely in engaging lengths of shaft in the bearings and placing the lengths of shaft in mutual end-to-end engagement. Such assembly by mere engagement in bearings distributed up the height of the shaft would not be possible if the shaft were in a single piece, since the mechanical coupling means of the shaft would then interfere with the bearings.

In a particular embodiment, the means for displacing the wheels towards their declutched positions comprise:

a vertical rod provided with transverse arms and mounted to slide vertically between a rest position in which the transverse arms do not interfere with the wheels, and an active position in which the transverse arms urge all of the wheels into their declutched positions;

an actuator for displacing the rod into its active position; and means for returning the rod to its rest position.

The tray declutching mechanism is thus very simple.

An additional technical problem is to guarantee that the trays come to rest in indexed angular positions. According to the invention, this problem is solved by a cabinet as defined above, in which:

the cabinet includes a control circuit for controlling the electric motor and the means for selectively either coupling each of said trays to the drive shaft by means of the respective wheel, or else for decoupling said trays from the drive shaft;

the cabinet includes a control panel connected to the control circuit to start rotation of a tray;

the trays include index members projecting radially outwards;

the cabinet includes a stationary detector for each tray to detect the proximity of one of the index members of said tray when rotating, each detector being connected to the control circuit to apply a signal to said control circuit indicative of the presence of said index member, the control circuit being adapted, on receiving said signal, to control stopping of said rotating tray;

the cabinet further includes locking members for locking the index member when it comes into the vicinity of the detector; and the cabinet also includes release means for displacing the locking members into retracted positions where they no longer interfere with the index members, said release means including at least one electrical release actuator controlled by the control circuit to displace the locking members into their retracted positions.

It may be observed that the indexing mechanism could be used in any type of cabinet having rotary trays, regardless of whether it has a hollow central post containing the drive shaft.

In a particular embodiment, the locking members are disposed in pairs on either side of each detector, each locking member including a free end and a fixed end, the free end being adjacent to the detector, the free end being disposed in such a manner as to interfere with the index members of a tray, and the said locking member is elastically deformable in a radial direction relative to the vertical axis of the cabinet so as to be displaced into its retracted position.

Thus, the user starts rotation of a tray in a given direction, and then when the tray index member comes close to the detector, it urges a first locking member towards a retracted position and is then stopped by a second locking member at the same time as the detector detects the presence of the index member, thereby causing drive to the tray to be stopped. The index member then remains captive between the two locking members.

To damp the stopping of the index member by the second locking member, it is advantageous for said locking members also to be elastically deformable in a circumferential direction about the vertical axis of the cabinet.

Furthermore, in the event of an electrical power failure, it is useful to be able to use the cabinet by moving the trays manually. To this end, it is advantageous for the release means to further include a manual actuator for displacing the locking members into their retracted positions.

In a particular embodiment, the locking members are vertically aligned in two columns, the release means comprising two cam members each acting on all of the locking members in a respective column to displace them into their retracted positions, the two cam members are linked together to act simultaneously on all of the locking members in both columns, and the manual actuator includes a cable connected to a crank lever which is secured to one of the cam members.

BRIEF DESCRIPTION OF THE DRAWINGS

Other characteristics and advantages of the invention appear on reading the following description of an embodiment of the invention given by way of non-limiting example and with reference to the accompanying drawings.

In the drawings:

FIG. 1 is a perspective view of a cabinet constituting an embodiment of the invention;

FIG. 7 is a diagrammatic view of the mechanism for actuating cam members which control the retracting of the tray-locking members.

MORE DETAILED DESCRIPTION

FIG. 1 shows an embodiment of a storage cabinet of the invention. The cabinet comprises a casing 50 in which superposed trays 1 are mounted to rotate about a common vertical axis. The trays 1 preferably include respective notches 3 in the form of circular sectors. The casing 50 has an open front face, and in the rest position, all of the trays 1 are disposed so that their notches 3 are directed towards the open front face of the casing 50, thereby forming an empty triangular column. The casing 50 also includes a control panel 18 which enables any particular tray to be caused selectively to rotate in one direction or the other so as to bring said tray into the empty column, thereby enabling a user to access the contents of said tray.

Figure 2:
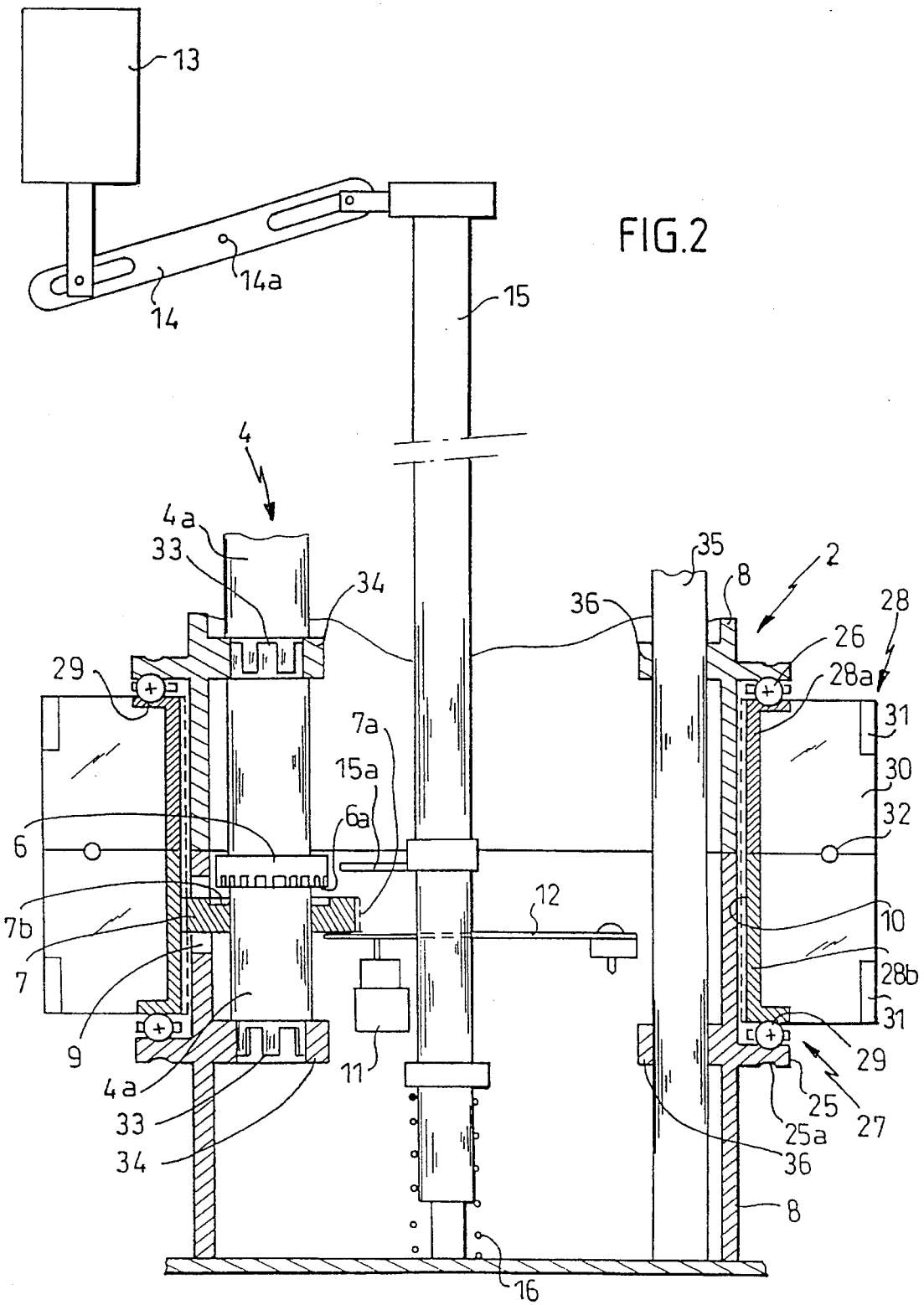
FIG. 2 is a fragmentary vertical section through the cabinet of FIG. 1.

FIG. 2 is a fragmentary vertical section view through the cabinet of FIG. 1, showing how the trays are rotated. The trays 1 are mounted to rotate about a vertical post 2 constituted by a stack of cylindrical elements 8, two of which are shown in FIG. 2. Each cylindrical element 8 includes an outwardly-directed annular flange 25 each of whose top and bottom faces includes a running path 25*a* enabling the balls 26 of a ball bearing 27 to run thereon. The cylindrical elements 8 may be made out of molded plastics material. The cylindrical elements 8 may be fixed to one another and to the casing 50 by any known means. For example, the cylindrical elements 8 may include inside lugs 36 threaded onto one or more vertical rods 35 which are secured to the casing 50; however numerous variants are possible.

Between the annular flanges 25 of two adjacent cylindrical elements 8, there is mounted a support ring 28 that forms a portion of a tray 1. The support ring 28 may likewise be made of molded plastics material, and to facilitate molding, it may be built up from two parts 28*a* and 28*b*. The support ring 28 includes two running paths 29, namely a bottom path and a top path disposed to face running paths 25*a* of the annular flanges 25. Two ball bearings 27 are thus interposed between the support ring 28 and the post: one co-operating with the annular flange 25 disposed immediately beneath the support ring 28, and the other co-operating with the flange immediately above it. The support ring 28 also includes inside teeth 10 and outside radial plates 30 each including one or more snap-fastening projections 31 and/or one or more fixing holes 32 for securing radial arms, e.g. made of metal, to support the tray 1. This particular way of implementing the trays 1 is merely an example, and numerous variants are possible.

The storage cabinet also includes a drive shaft 4 made up of lengths 4*a* that may be molded out of plastics material. Each length 4*a* of the drive shaft extends vertically between two axial ends 33 of smaller diameter, each having a set of teeth in the form of axial cancellations. Internally, each cylindrical element 8 includes a bearing 34 having a vertical inside bore of diameter that corresponds substantially to the diameter of the smaller-diameter ends 33 of the lengths 4*a*. The two axial ends 33 of each length 4*a* are engaged in respective bearings 34 in two successive cylindrical elements 8, and the various successive lengths 4*a* are constrained to rotate together by coupling between their axial teeth at their axial ends 33. Each length 4*a* also includes a collar 6 provided with axial teeth 6*a*.

A gear wheel 7 is mounted to slide freely on and to rotate freely about each length 4*a*, the gear wheel 7 having outside teeth 7*a* and axial teeth 7*b* disposed facing the axial teeth 6*a* of the collar 6. Each cylindrical element 8 includes a window 9 through its wall, with one of said gear wheels 7 projecting therethrough so that the outside teeth 7*a* of the gear wheel 7 mesh with the inside teeth 10 of the corresponding support ring 28. The gear wheel 7 is axially displaceable between a declutched position as shown in FIG. 2 where it is meshing with the support ring 28 but not with the shaft 4, and a clutched position where it meshes simultaneously with the inside teeth 10 of the support ring 28 and with the axial teeth 6*a* of the shaft collar 6. For each gear wheel 7, the cabinet includes an electrical solenoid actuator 11 associated with a lever 12 which may be constituted by a resilient metal strip for moving a selected gear wheel 7 from its declutched position into its clutched position.

In addition, the cabinet includes means for declutching all of the gear wheels 7. These means comprise a vertical rod 15 that is mounted to slide vertically and that is provided with a transverse arm 15*a* for each gear wheel 7. The bottom end of the rod 15 is associated with a coil spring 16 which urges the rod 15 into a high position where its transverse arms 15*a* do not interfere with the gear wheels 7. In addition, the top end of the rod 15 is connected to an electrical solenoid actuator 13 via a lever 14 that is hinged about a fixed point 14*a* and that serves to urge the rod 15 downwards, thereby causing the transverse arms 15*a* to move all of the gear wheels 7 into their declutched positions.

It may be observed that the coupling between a tray and the drive shaft can be implemented in a different manner without going beyond the ambit of the invention. For example, the gear wheel 7 could be replaced by a friction wheel, in which case the inside teeth 10 should be constituted by a friction surface. Under such circumstances, the wheel could be displaceable in a direction that is not parallel to the drive shaft 4, when going between its clutched position and its declutched position.

Figure 4:
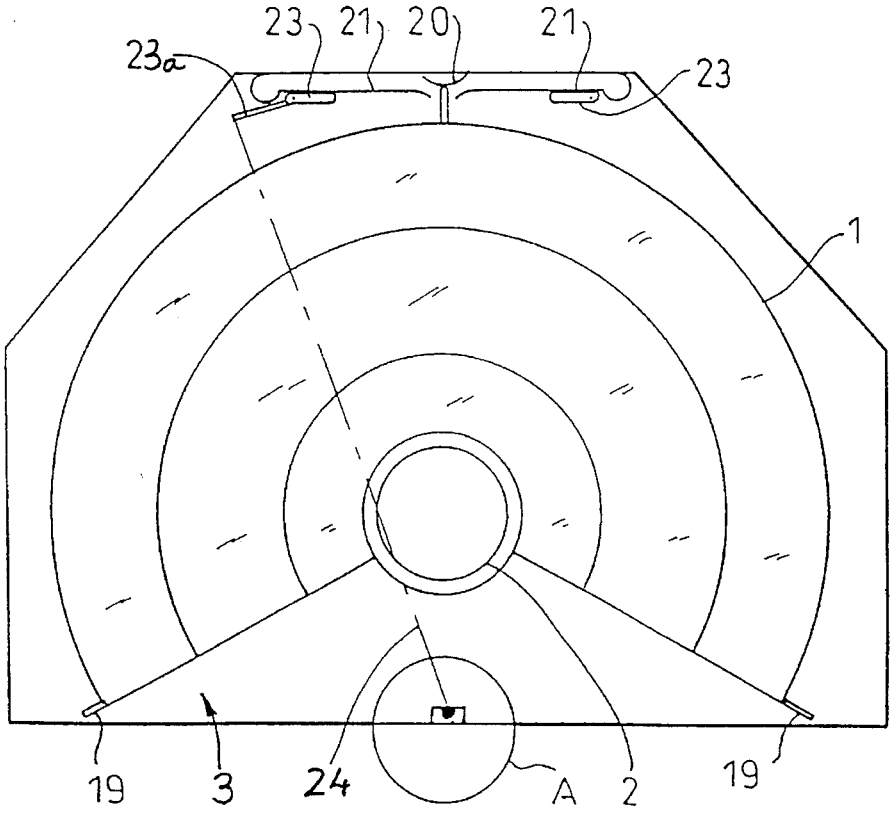
FIG. 4 is a diagrammatic horizontal section through the cabinet of FIG. 1.
Figure 5:
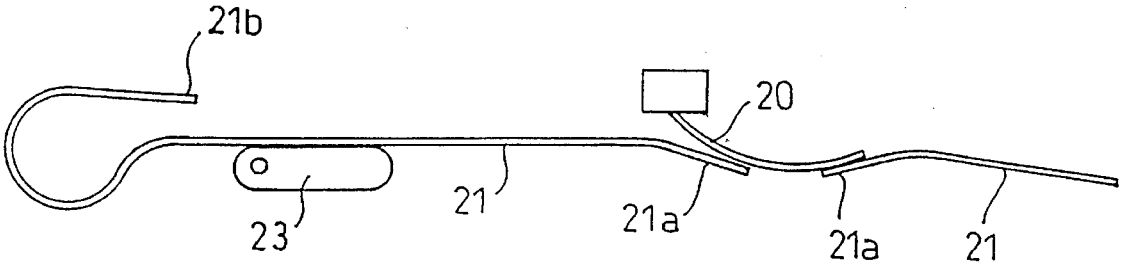
FIG. 5 is a plan view of the tray-locking members.

The cabinet also includes indexing means to guarantee that the trays 1 stop in predetermined angular positions. As can be seen in FIGS. 4 and 5 this is done by each tray 1 including index members 19 on its outer periphery that project radially outwards. In addition, in its rear portion, the cabinet includes a vertical alignment of detectors 20 for each of the trays, the detectors being constituted in the example shown merely by small metal strips. Each detector 20 is surrounded by two metal locking springs 21, each comprising a free end 21*a* adjacent to the detector 20 and a fixed end 21*b* further away from the detector 20. The free end 21*a* of each locking spring 21 is disposed to interfere with the index members 19 of a tray, and the locking spring is elastically deformable in a radial direction relative to the central axis of the cabinet so as to enable it to be displaced into a retracted position where it does not interfere with the index members 19 of the tray. In the example shown, the metal strip 20 is in contact with the two locking springs 21 on either side thereof, so long as an index member 19 is not to be found between the two locking springs 21. This contact closes an electrical circuit which is opened whenever an index member 19 is to be found between the two locking springs 21 so as to bear against the strip 20 (see FIG. 4): it is this interrupting of the electrical contact that is representative of the presence of an index member 19. In a variant, the displacement of the strip 20 could also actuate a switch. It would also be possible to envisage replacing the strip 20 with a reed switch.

In addition, the cabinet includes two cam members 23 that are vertical and mounted to rotate about respective eccentric vertical axes, the cam members extending up the entire height of the cabinet and being adapted to displace the locking springs 21 into their retracted positions. As shown in FIG. 7, the two cam members 23 may be hinged together so as to act simultaneously on both columns of locking springs 21. In the example shown, each cam member 23 is secured to a crank lever 37 whose free end is hinged to one end of a rod 38, the other end of the rod being hinged on a horizontal plate 39 mounted to rotate about a vertical axis 40. The cam members 23 are controlled by two electrical solenoid actuators 22, each having an actuating rod 22*a* whose free end is hinged to one end of a rod 41, the other end of the rod being hinged to the plate 39.

Figure 4A:
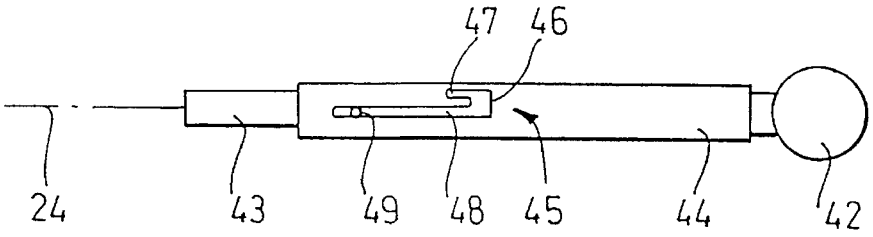
FIG. 4A is a view showing a detail of FIG. 4.

In addition, one of the cam members 23 is secured to a crank lever 23*a* whose free end is connected to one end of a cable 24 whose other end is fixed to a handle 42 disposed on the front face of the cabinet, as can be seen in FIGS. 4 and 4*a*. By pulling on the handle 42, it is possible to displace both cam members 23 so as to put all of the locking springs 21 into their retracted positions. As shown in FIG. 4*a*, in a particular embodiment, the handle 42 is secured to a cylindrical bolt 43 which slides in a stationary cylindrical sleeve 44. The sleeve 44 includes a (back to front) J-shaped slot 45, with the bottom 46 of the J-shape being closer to the handle 42, and with the J-shape including a short branch 47 and a long branch 48. The cylindrical bolt 43 has a radial peg 49 which projects into the slot 45. When the peg 49 is in the long branch 48 of the J-shape, then the cable 24 is relaxed and it does not act on the cam members 23. In contrast, by pulling on the handle 42 and rotating it slightly so as to place the peg 49 in the short branch 47 of the J-shape, the cable 24 is tensioned so as to act on the cam members 23, thereby holding the locking springs 21 in their retracted positions.

Figure 3:
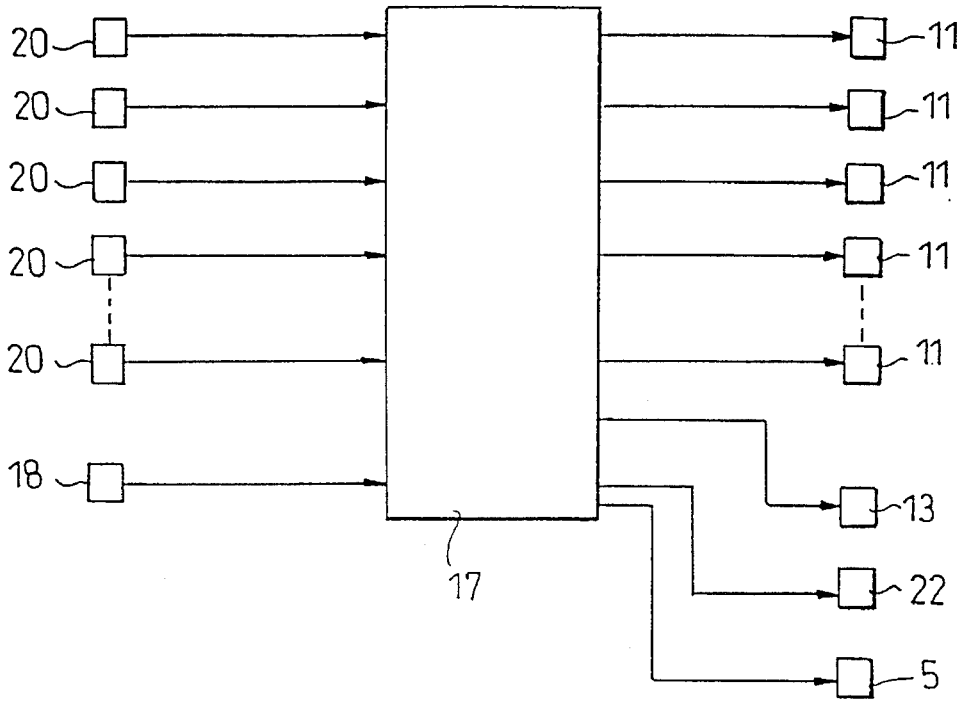
FIG. 3 is a simplified electrical circuit diagram of the cabinet of FIG. 1.

As shown in FIG. 3, the cabinet includes a control circuit 17 which receives electrical signals from the control panel 18, together with detectors 20 that detect the presence of the index members 19. In addition, the control circuit 17 is connected: to the various electrical solenoid actuators 11 which control clutching of the various gear wheels 7; to the electrical actuator 13 which controls declutching of all of the gear wheels 7 together; to the electrical actuators 22 which control the displacement of the cam members 23; and to the electric motor 5 which rotates the drive shaft 4.

The cabinet operates as follows:

in the starting position, all of the trays 1 are disposed with their notches 3 facing towards the front of the cabinet;

when a user seeks to access a tray, a particular tray is caused to rotate in one direction or the other by pressing the appropriate one of the buttons in the control panel 18. The control panel 18 applies a signal to the control circuit 17 which then switches on: one of the electrical actuators 11 to cause the corresponding gear wheel 7 to be clutched; the electrical actuators 22 to put the locking springs 21 in their retracted positions; and the motor 5 to start rotation of the drive shaft 4 and thus of the desired tray 1;

after a predetermined length of time, the electrical actuators 22 are released so that the locking springs 21 return to their rest positions under their own resilience; and an index member subsequently arrives in the vicinity of the column of detectors 20: during this movement, the index member 19 pushes back the first locking spring 21 that it encounters, but comes axially into abutment against the second locking spring 21, while simultaneously the first locking spring 21 that it has already encountered returns to its rest position once the index member 19 has gone past it. As a result, the index member 19 is locked in a predetermined position where it presses against the metal strip 20, thereby breaking contact between the metal strip 20 and the locking springs 21. This loss of contact is detected by the control circuit 17 which then stops the motor 5 and instructs the electrical actuator 13 to declutch the gear wheel 7 that had previously been in the clutched position.

Figure 6:
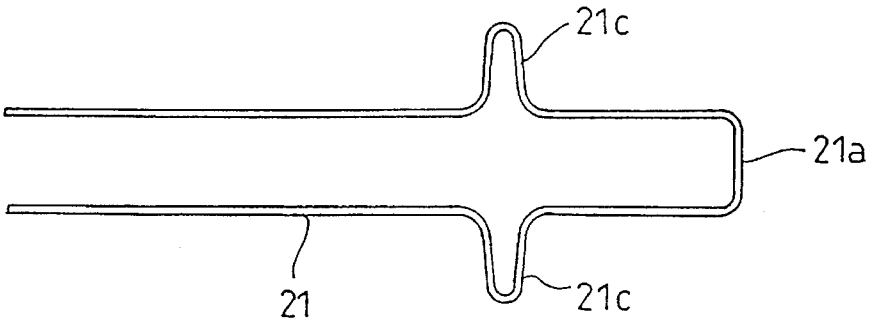
FIG. 6 is an elevation view of a FIG. 5 locking member.

To damp the shock between the locking springs 21 and the tray, it is advantageous for the locking springs 21 to have a degree of resilience in a circumferential direction about the axis of the cabinet. For this purpose, the spring 21 may be in the form of a wire including undulations 21*c* along its length, as shown in FIG. 6.

In the event of an electrical power failure, the user can put all of the locking springs 21 into their retracted positions by means of the handle 42 and the cable 24, thereby enabling the trays to be displaced manually.

In the example shown, each tray has a 120° notch, and is provided with three index members 19 that are distributed at 120° intervals. This disposition is particularly advantageous, since it makes it possible to access any portion of a tray in a single operation, providing the appropriate direction of rotation is selected for the tray.

I claim:

1. A storage cabinet including a plurality of superposed trays for storing objects of small size, said trays being mounted to rotate about a common vertical axis, the trays being rotated by a vertical drive shaft controlled by an electric motor, each tray being adapted to be selectively engaged with the drive shaft independently of the other trays, wherein said vertical axis comprises a hollow vertical post, said drive shaft is disposed inside said hollow post, each tray includes an inside periphery provided with a drive surface, the hollow post includes, for each tray, a window through 9 wall thereof facing the drive surface of the tray, and the cabinet includes, for each tray, clutch means comprising:

a wheel mounted to rotate about a vertical axis and passing through said window, the wheel being adapted to be in engagement simultaneously with the drive shaft and with the drive surface of the tray; and means for selectively either coupling said tray to the drive shaft by means of said wheel, or else decoupling said tray from the drive shaft.

2. A cabinet according to claim 1, in which, for each tray, said drive surface is constituted by inside teeth, and said wheel is a pear wheel.

3. A cabinet according to claim 1, in which, for each tray, said wheel is permanently engaged with the drive surface of said tray, and said means for selectively either coupling said tray to the drive shaft by means of said wheel or else decoupling said tray from the drive shaft comprise means for selectively coupling said wheel to the drive shaft or for decoupling said wheel from the drive shaft.

4. A cabinet according to claim 1, in which, for each tray, said clutch means further includes mechanical coupling means integral with the drive shaft, said wheel is axially displaceable parallel to the drive shaft between a clutched position where said wheel is in engagement both with said tray and with said mechanical coupling means integral with the drive shaft, and a declutched position in which said wheel is not in engagement both with said tray and with said mechanical coupling means integral with the drive shaft, and said means for selectively either coupling said tray to the drive shaft by means of said wheel, or else decoupling said tray from the drive shaft comprise:

means for displacing the wheel towards said clutched position independently of the position of the wheels corresponding to the other trays; and means for displacing the wheel towards said declutched position.

5. A cabinet according to claim 4, in which the means for displacing the wheels towards their declutched positions comprise:

a vertical rod provided with transverse arms and mounted to slide vertically between a rest position in which the transverse arms do not interfere with the wheels, and an active position in which the transverse arms urge all of the wheels into declutched positions thereof;

an actuator for displacing the rod into said active position; and means for returning the rod to said rest position.

6. A cabinet according to claim 1, in which said hollow vertical post is made up of cylindrical elements that are superposed and secured to one another.

7. A cabinet according to claim 6, in which said cylindrical elements on which the trays are mounted to rotate, are all identical.

8. A cabinet according to claim 6, in which the drive shaft is made up of a plurality of sections that are disposed end-to-end and that are constrained to rotate with one another, each section including mechanical coupling means adapted to couple said section to an associated one of the wheels, with each section being mounted to rotate by being engaged in two bearings forming parts of two respective adjacent ones of the cylindrical elements.

9. A cabinet according to claim 1, in which:

the cabinet includes a control circuit for controlling the electric motor and the means for selectively either coupling each of said trays to the drive shaft by means of respective wheel, or else for decoupling said trays from the drive shaft;

the cabinet includes a control panel connected to the control circuit to start rotation of a tray;

the trays include index members projecting radially outwards;

the cabinet includes a stationary detector for each tray to detect a proximity of one of the index members of said tray when rotating, each detector being connected to the control circuit to apply a signal to said control circuit indicative of a presence of said index member, the control circuit being adapted, on receiving said signal, to control stopping of said rotating tray;

the cabinet further includes locking members for locking the index member when said index member comes into a vicinity of the detector; and the cabinet also includes release means for displacing the locking members into retracted positions whereat the locking members no longer interfere with the index members, said release means including at least one electrical release actuator controlled by the control circuit to displace the locking members into said retracted positions.

10. A cabinet according to claim 9, in which the locking members are disposed in pairs on either side of each detector, each locking member including a free end and a fixed end, the free end being adjacent to the detector and disposed in such a manner as to interfere with the index members of a tray, and each locking member being elastically deformable in a radial direction relative to the vertical axis of the cabinet so as to be displaced into said retracted position.

11. A cabinet according to claim 10, in which said locking members are also elastically deformable in a circumferential direction about the vertical axis of the cabinet.

12. A cabinet according to claim 9, in which the release means further include a manual actuator for displacing the locking members into said retracted positions.

13. A cabinet according to claim 12, in which the locking members are vertically aligned in two columns, the release means comprising two cam members each acting on all of the locking members in a respective column to displace them into said retracted positions, the two cam members are linked together to act simultaneously on all of the locking members in both columns, and the manual actuator includes a cable connected to a crank lever which is secured to one of the cam members.

* * * * *